US011551530B2

(12) United States Patent
Brikho

(10) Patent No.: US 11,551,530 B2
(45) Date of Patent: Jan. 10, 2023

(54) MULTI-BALL ROULETTE WHEEL WITH STACKED TRACKS

(71) Applicant: Ghazwan Brikho, West Bloomfield, MI (US)

(72) Inventor: Ghazwan Brikho, West Bloomfield, MI (US)

( * ) Notice: Subject to any disclaimer, the term of this patent is extended or adjusted under 35 U.S.C. 154(b) by 130 days.

(21) Appl. No.: 16/816,510

(22) Filed: Mar. 12, 2020

(65) Prior Publication Data

US 2020/0211332 A1 Jul. 2, 2020

Related U.S. Application Data

(63) Continuation-in-part of application No. 15/778,488, filed as application No. PCT/US2016/062325 on Nov. 16, 2016, now abandoned.

(Continued)

(51) Int. Cl.
*A63F 5/00* (2006.01)
*G07F 17/32* (2006.01)

(52) U.S. Cl.
CPC ..... *G07F 17/3288* (2013.01); *A63F 5/0088* (2013.01); *G07F 17/322* (2013.01); *G07F 17/3244* (2013.01)

(58) Field of Classification Search
CPC ... A63F 5/0088; G07F 17/322; G07F 17/3244
See application file for complete search history.

(56) References Cited

U.S. PATENT DOCUMENTS 4,906,005 A * 3/1990 Manabe ..... A63F 5/00 273/142 B
5,755,440 A * 5/1998 Sher ..... A63F 5/00 273/142 E (Continued)

FOREIGN PATENT DOCUMENTS

GB 369233 A 3/1932
WO WO-2007149180 A2 * 12/2007 ..... G07F 17/32

(Continued)

OTHER PUBLICATIONS

International Search Report dated Feb. 27, 2017 for International Application No. PCT/US2016/062325 filed Nov. 16, 2016.

*Primary Examiner* — Corbett B Coburn
(74) *Attorney, Agent, or Firm* — Blue Filament Law PLLC

(57) ABSTRACT

A method and system based on betting using an enhanced roulette game are provided with more exciting game play with differing odds as compared to traditional roulette. The roulette game has a two-track roulette wheel, each track having cross-sectional curvatures allowing for the simultaneous use of two separate balls that do not interfere with each other during game play, with an increased number of betting numbers of 63 (1-60, 0, 00, and 000) or 75 (0, 00, 000, 1-72) around a single course of pockets or cassettes. One of the two roulette balls may be a "gold" ball that represents a bonus payout or bonus for hitting both numbers for one or more players. A set of playing chips have radio frequency identification (RFID), or other locating devices that interact with the grid to determine chip placement on the betting layout to automatically calculate a bet payoff.

9 Claims, 6 Drawing Sheets

Related U.S. Application Data

(60) Provisional application No. 62/258,771, filed on Nov. 23, 2015.

(56) References Cited

U.S. PATENT DOCUMENTS 5,775,993 A * 7/1998 Fentz ..... G07F 17/3262 463/17
5,836,583 A * 11/1998 Towers ..... G01S 7/4815 273/142 B
6,209,869 B1 * 4/2001 Mathews ..... A63F 5/00 273/138.1
7,669,850 B1 * 3/2010 Miller ..... A63F 5/00 273/143 R
7,674,172 B2 * 3/2010 Miltenberger ..... G07F 17/322 463/17
7,926,808 B1 4/2011 Gullotta
7,938,722 B2 5/2011 Igt
8,348,277 B2 1/2013 Fitoussi
9,327,186 B1 * 5/2016 Pececnik ..... A63F 5/0088
2006/0267274 A1 * 11/2006 Cammegh ..... A63F 5/0005 273/143 R
2007/0035399 A1 * 2/2007 Hecht ..... G07F 17/322 340/572.1
2007/0075488 A1 * 4/2007 Pececnik ..... A63F 5/02 273/138.1
2008/0076507 A1 3/2008 Wertheimer
2009/0221364 A1 * 9/2009 Richard ..... A44C 21/00 463/29
2010/0273547 A1 * 10/2010 Stasi ..... G07F 17/3269 463/16
2010/0301556 A1 * 12/2010 Kido ..... G07F 17/3216 273/142 E
2012/0061912 A1 * 3/2012 Sorge ..... A63F 5/00 273/142 E
2012/0172103 A1 * 7/2012 Gurule ..... G07F 17/3258 463/17
2012/0252564 A1 * 10/2012 Moore ..... G07F 17/3237 463/25
2014/0098219 A1 * 4/2014 Berry, III ..... G07F 17/32 348/125
2014/0370955 A1 * 12/2014 Pertgen ..... G07F 17/323 463/16
2015/0312517 A1 10/2015 Hoyt et al.
2015/0335992 A1 * 11/2015 Fisher ..... A63F 5/02 273/142 G

FOREIGN PATENT DOCUMENTS

WO 2009006863 A1 1/2009
WO 2014135713 A1 9/2014

* cited by examiner

MULTI-BALL ROULETTE WHEEL WITH STACKED TRACKS

RELATED APPLICATIONS

This application is a continuation-in-part of U.S. application Ser. No. 15/778,488 filed 23 May 2018 that in turn is a U.S. National Phase of PCT Application Serial No. PCT/US2016/062325 filed 16 Nov. 2016 that in turn claims priority benefit of U.S. Provisional Application Ser. No. 62/258,771 filed 23 Nov. 2015; the contents of which are hereby incorporated by reference.

FIELD OF THE INVENTION

The present invention generally relates to gaming, and more specifically to systems and methods based on betting using modified and enhanced roulette.

BACKGROUND OF THE INVENTION

Roulette is a game of chance named after the French word meaning little wheel. In a game of roulette, players may choose to place bets on either a single number or a range of numbers, the colors red or black, or whether the number is odd or even. A winning roulette number and color is determined when a croupier spins a wheel in one direction, then spins a ball in the opposite direction around a circular track running around the circumference of the wheel. The ball eventually loses momentum and falls onto the wheel and into one of 37 (in French/European roulette) or 38 (in American roulette) colored and numbered pockets or cassettes on the wheel.

FIG. 1 illustrates a typical prior art roulette table 10. The roulette wheel 12 has a series of pockets 14 that are numbered from 1 to 36. In number ranges from 1 to 10 and 19 to 28, odd numbers are red and even are black. In ranges from 11 to 18 and 29 to 36, odd numbers are black and even are red. There is a green pocket numbered 0 (zero). In American roulette, there is a second green pocket marked 00. Pocket number order on the roulette wheel adheres to the following clockwise sequence in most casinos:

Single-Zero Wheel 0-32-15-19-4-21-2-25-17-34-6 27 13 36 11 30 8-23-10-5-24-16-33-1-20-14-31-9-22-18-29-7-28-12-35-3-26

Double-Zero Wheel 0-28-9-26-30-11-7-20-32-17-5-22-34-15-3-24-36-13-1-00-27-10-25-29-12-8-19-31-18-6-21-33-16-4-23-35-14-2

The cloth covered betting area 16 on a roulette table 10 is known as the layout.

The advent of new gambling venues and games of chance has led to a decrease in the popularity of roulette. Thus, there is a need for a system and method based on betting using enhanced roulette to increase the game playing appeal of roulette.

SUMMARY OF THE INVENTION

A method based on betting using roulette includes placing bets on the outcome of a roulette wheel roll by placing chips on a betting layout on a roulette based game system, the system comprising the roulette wheel having an upper track and a lower track around a circumferential edge of the roulette wheel. The upper track and the lower track both have cross-sectional curvatures that complement a first roulette ball and a second roulette ball, respectively. A series of numbered and color coded pockets are arranged in a circle concentric with the roulette wheel. The first roulette ball and the second roulette ball for simultaneous play using the upper track and the lower track of the roulette wheel, respectively. The roulette based game system also includes a table surface holding the roulette wheel and a betting layout in a grid corresponding to the number of pockets in the roulette wheel for placing bets on the outcome of a roll of the roulette wheel. The roulette wheel is spun and the first and second ball are launched in an upper and lower track of the roulette wheel, respectively. The numbered and color coded pockets receive the first and second ball as their momentum decays to determine winning numbers and winning bets are paid.

A roulette based game system includes a roulette wheel with an upper track and a lower track around a circumferential edge of the roulette wheel, the upper track and the lower track both having cross-sectional curvatures that complement a first roulette ball and a second roulette ball, respectively. A series of numbered and color coded pockets are arranged in a circle concentric with the roulette wheel. The first roulette ball and the second roulette ball for simultaneous play use the upper track and the lower track of the roulette wheel, respectively. A table surface holds the roulette wheel and a betting layout in a grid corresponding to the number of pockets in the roulette wheel for placing bets on the outcome of a roll of the roulette wheel. A set of playing chips that have radio frequency identification (RFID), or other locating devices interact with the grid to determine chip placement on the betting layout to automatically calculate a bet payoff.

BRIEF DESCRIPTION OF THE DRAWINGS

The present invention is further detailed with respect to the following drawings. These figures are not intended to limit the scope of the present invention but rather illustrate certain attributes thereof wherein.

DETAILED DESCRIPTION OF THE INVENTION

The present invention has utility as a system and method based on betting using an enhanced roulette game. Embodiments of the inventive roulette game provide for more exciting game play with differing odds as compared to traditional roulette. Embodiments of the inventive roulette game have a two-track roulette wheel for the simultaneous use of two separate balls during game play, with an increased number of betting numbers of 50 (0, 00, 000, 1-47), 63 (0, 00, 000, 1-60), or 75 (0, 00, 000, 1-72) around a single course of pockets or cassettes. In a specific embodiment one of the two roulette balls may be a "gold" ball that represents a bonus payout or bonus for hitting both numbers for one or more players.

Figure 2A:
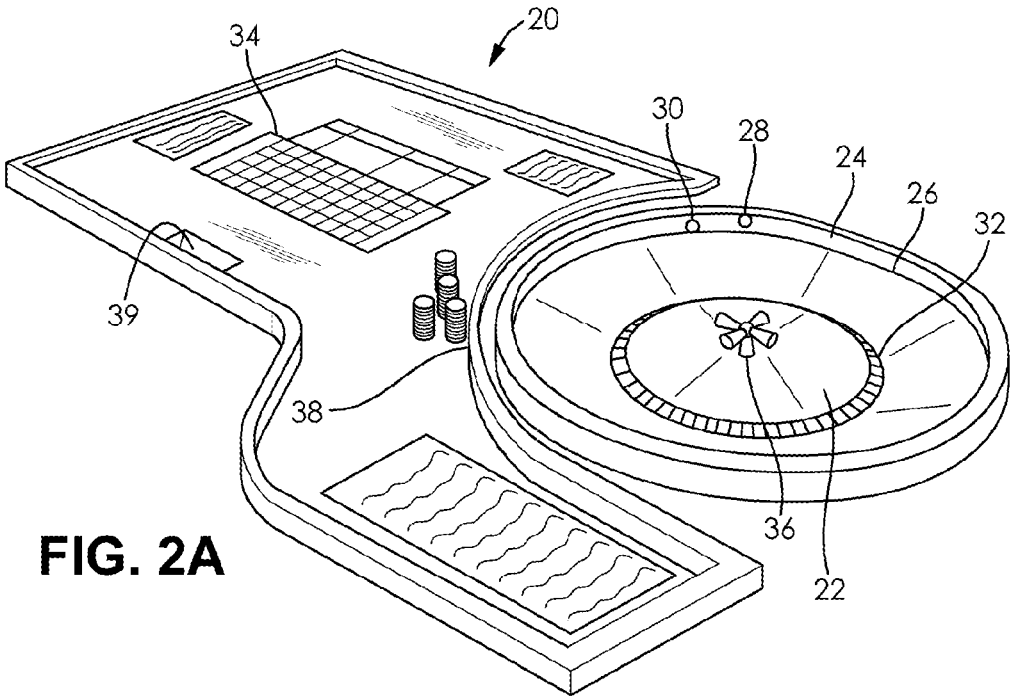
FIGS. 2A and 2B illustrate perspective views of an inventive roulette table in accordance with embodiments of the invention.
Figure 2B:
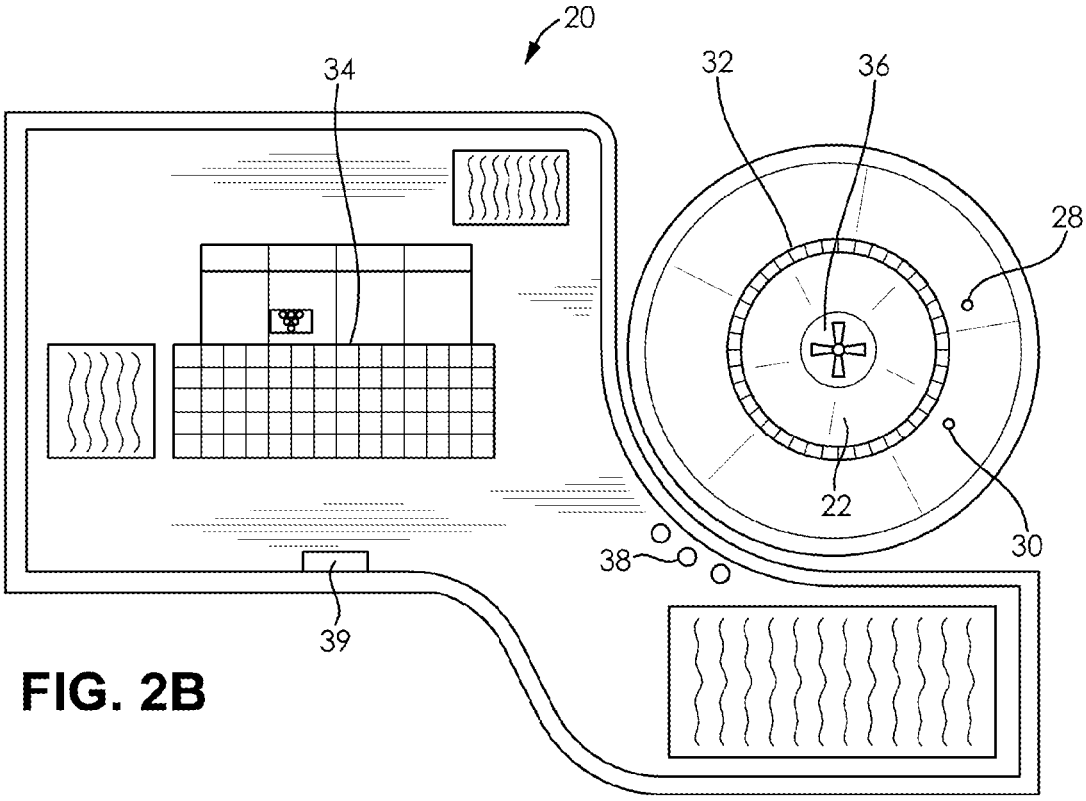

Referring now to the figures, FIGS. 2A and 2B are perspective views of the inventive roulette gamming table 20. The roulette wheel 22 has an upper track 24 and a lower track 26 for a first roulette ball 28 and a second roulette ball 30, respectively. In embodiments, it is appreciated that the upper track 24 and the lower track 26 both have cross-sectional curvatures 27 that complement the first roulette ball 28 and the second roulette ball 30, respectively. A series of pockets 32 are arranged in a circle that correspond to the betting numbers shown in the betting layout 34. The betting layout shown in FIGS. 2A and 2B (shown in greater detail in FIG. 4) have 63 numbers (0, 00, 000, 1-60).

Figure 1:
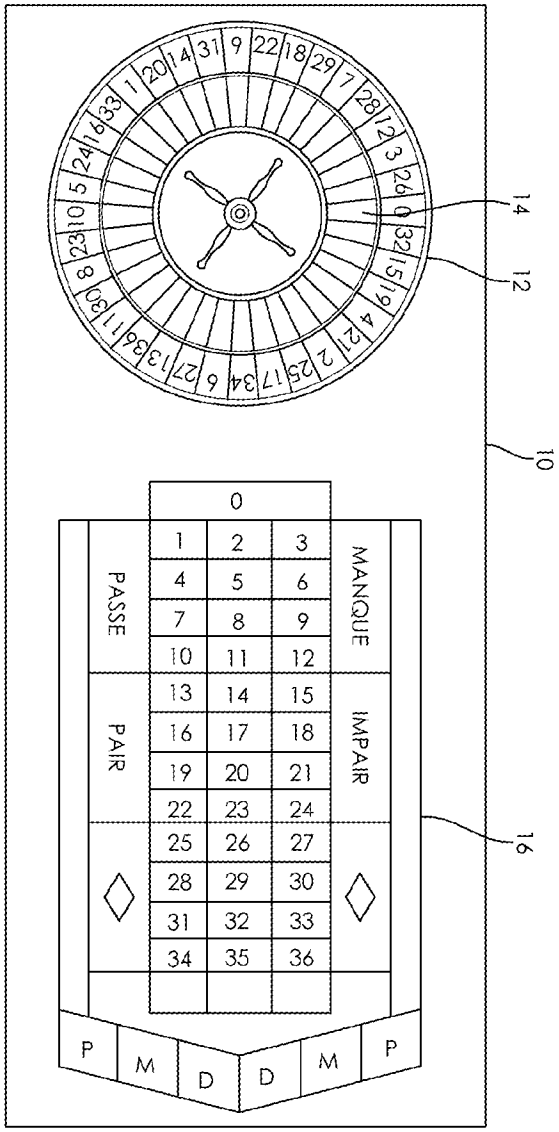
FIG. 1 (PRIOR ART)
FIG. 1 depicts a prior art roulette table.
Figure 3:
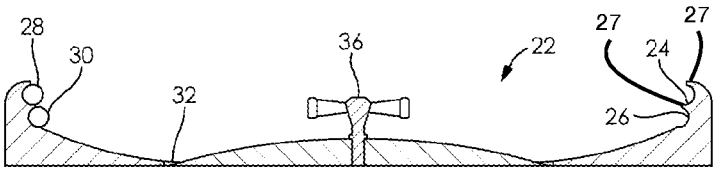
FIG. 3 illustrates a cross-sectional view of the inventive roulette wheel of FIG. 2A with two separate tracks having cross-sectional curvatures that complement a first roulette ball and a second roulette ball, respectively in accordance with embodiments of the invention.

FIG. 3 illustrates a cross-sectional view of the inventive roulette wheel of FIG. 2A with two separate ball tracks, an upper track 24 and a lower track 26 for the first roulette ball 28 and the second roulette ball 30, respectively. In embodiments, it is appreciated that the upper track 24 and the lower track 26 both have cross-sectional curvatures 27 that complement the first roulette ball 28 and the second roulette ball 30, respectively. In some inventive embodiments, it is appreciated that the cross-sectional curvatures 27 complement the first roulette ball 28 and the second roulette ball 30 by retaining each ball in its respective track as it spins, thereby preventing the first roulette ball 28 and the second roulette ball 30 from occupying the same track where they might interfere with one another and hinder gameplay. As with traditional roulette wheels as described with respect to FIG. 1, as the first and second balls 28 and 30 lose momentum the balls fall onto the wheel 22 and into one of colored and numbered pockets or cassettes 32 on the wheel 22. It is appreciated that as the first roulette ball 28 and the second roulette ball 30 lose inertia, the cross-sectional curvatures 27 ensure that the first and second roulette balls 28 and 30 fall onto the wheel 22 without interfering with one another. The croupier (table operator) spins the wheel 22 using the handle 36.

Figure 4:
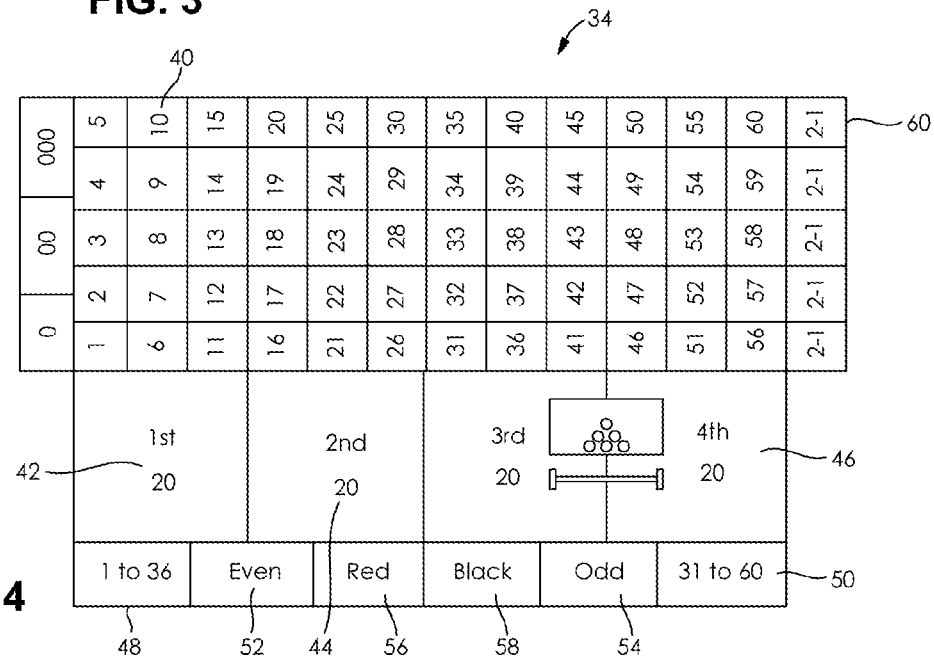
FIG. 4 depicts an inventive betting layout with 63 numbers (0, 00, 000, 1-63) in accordance with embodiments of the invention.

FIG. 4 depicts an inventive betting layout 34 with 63 numbers (0, 00, 000, 1-60) shown as a grid 40 that corresponds to the roulette wheel of FIGS. 2A and 2B. As with traditional roulette the placement of chips 38 on the numbers, borders, corners, lines, or other areas of the layout 34 designate a player's picks (and combinations thereof) for a roulette roll. Areas 42, 44, and 46 are representative for betting on the $1^{st}$ 20 numbers (1-20), $2^{nd}$ 20 numbers (21-40), and $3^{rd}$ 20 numbers (41-60), respectively. Bets on numbers 1-30 or 31-60 are placed via areas 48 and 50, respectively. Bets on an even or odd number are placed via areas 52 and 54, respectively. Bets on the color red or black that corresponds to the pocket the roulette balls fall into are chosen via placement of chips in areas 56 and 58, respectively. A 2 for 1 is chosen with chips placed in the areas 60 of the betting layout 34.

Figure 5:
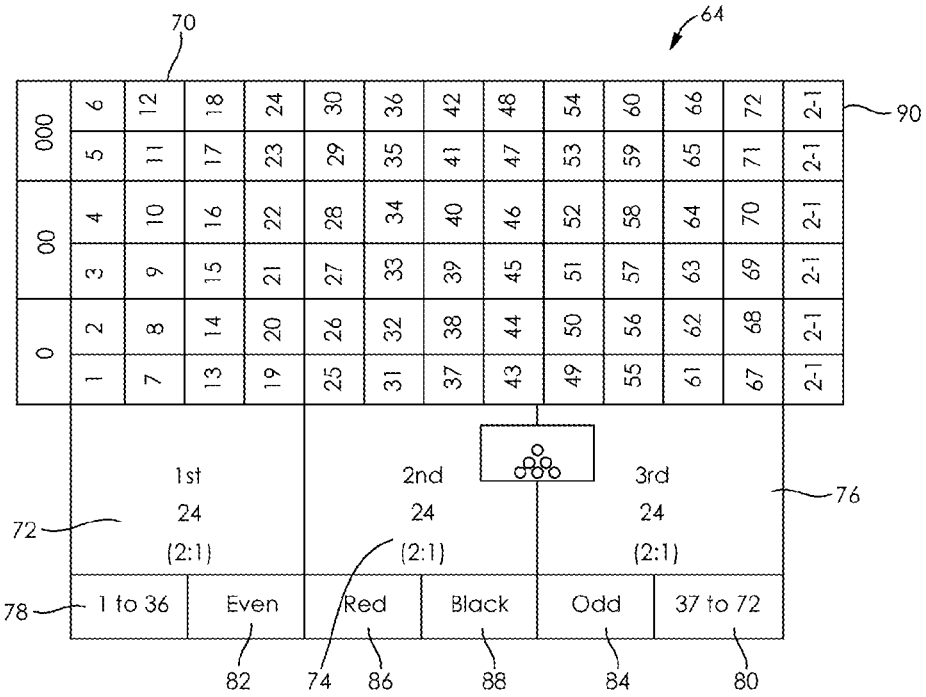
FIG. 5 depicts an inventive betting layout h 75 numbers (0, 00, 000, 1-72) accordance with embodiments of the invention.
Figure 7:
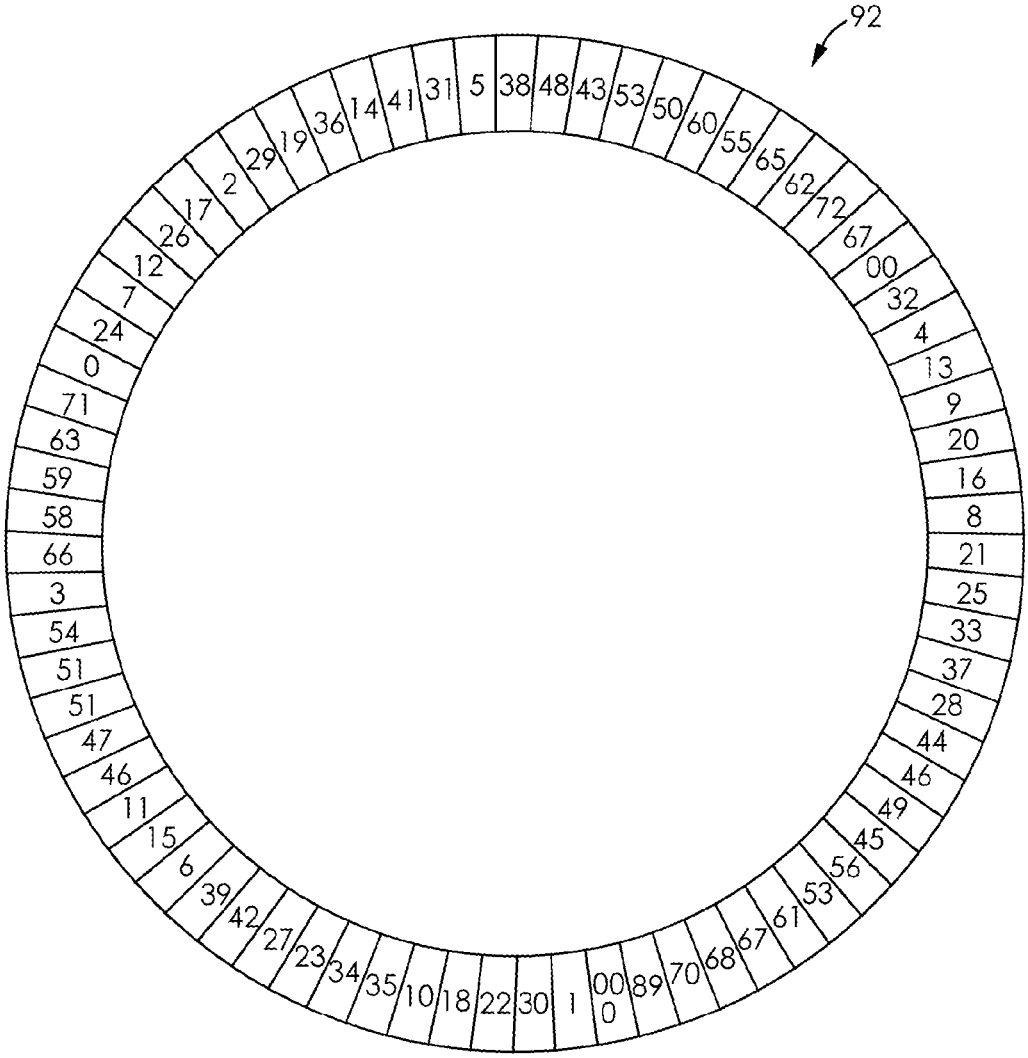
FIG. 7 depicts an inventive roulette wheel with 75 numbers (0, 00, 000, 1-72) in accordance with embodiments of the invention.

FIG. 5 depicts an inventive betting layout 64 with 75 numbers (0, 00, 000, 1-72) shown as a grid 70 that corresponds to the roulette wheel 92 of FIG. 7. As with traditional roulette the placement of chips 38 on the numbers, borders, corners, lines, or other areas of the layout 64 designate a player's picks (and combinations thereof) for a roulette roll. Areas 72, 74, and 76 are representative for betting on the $1^{st}$ 24 numbers (1-24), $2^{nd}$ 24 numbers (25-48), and $3^{rd}$ 24 numbers (49-72), respectively. Bets on numbers 1-36 or 37-72 are placed via areas 78 and 80, respectively. Bets on an even or odd number are placed via areas 82 and 84, respectively. Bets on the color red or black that corresponds to the pocket the roulette balls fall into are chosen via placement of chips in areas 86 and 88, respectively. A 2 for 1 is chosen with chips placed in the areas 90 of the betting layout 64.

Figure 6:
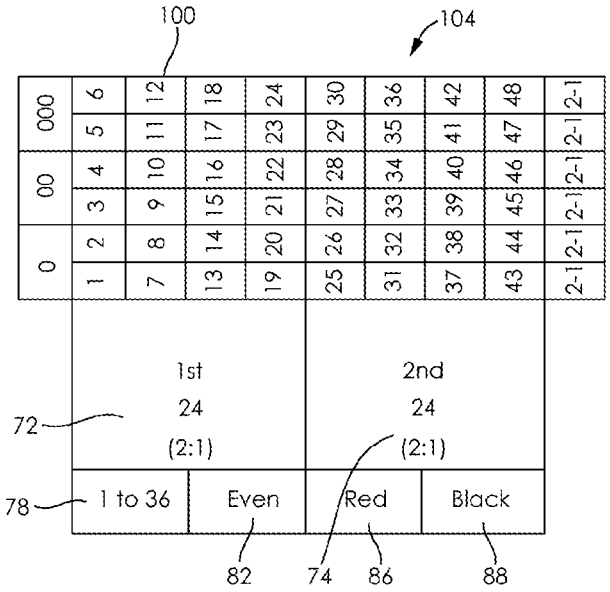
FIG. 6 depicts an inventive betting layout with 50 numbers (0, 00, 000, 1-47) in accordance with embodiments of the invention.

FIG. 6 depicts an inventive betting layout 104 with 50 numbers (0, 00, 000, 1-47) shown as a grid 100. As with traditional roulette the placement of chips 38 on the numbers, borders, corners, lines, or other areas of the layout 104 designate a player's picks (and combinations thereof) for a roulette roll. Areas 102, 106, and 108 are representative for betting on the $1^{st}$ 24 numbers (1-24), $2^{nd}$ 24 numbers (25-48), and $3^{rd}$ 24 numbers (49-72), respectively. Bets on numbers 1-36 or 37-72 are placed via areas 78 and 80, respectively. Bets on an even or odd number are placed via areas 82 and 84, respectively. Bets on the color red or black that corresponds to the pocket the roulette balls fall into are chosen via placement of chips in areas 86 and 88, respectively. A 2 for 1 is chosen with chips placed in the areas 90 of the betting layout 64.

The player chips 38 may be equipped with radio frequency identification (RFID), or other locating devices that interact with the grid (40, 70, 100) to determine chip placement of a player to automatically calculate a bet payoff. The table holding the inventive roulette wheel may be equipped with a tower having a listing of numbers to indicate past numbers, with current numbers for a roll set as flashing. An electric eye may be used to sense winning numbers and post such information to a board for historical context viewing by players.

Table 1 and Table 2 provide a listing of the table odds and payoff for various roulette rolls.

TABLE 1

Table odds for 63 number roulette wheel.

| | Table odds |
|---|---|
| Single number | 30-1 |
| 2 numbers | 15-1 |
| 3 numbers | 10-1 |
| 4 numbers | 8-1 |
| 5 numbers | 6-1 |
| 8 numbers | 4-1 |
| 10 numbers | 3-1 |
| 12 numbers | 2-1 |
| 20 numbers | 1-1 |
| Odd | 1-1 |
| Even | 1-1 |
| Red | 1-1 |
| Black | 1-1 |

TABLE 2

Table odds for 75 number roulette wheel.

| | Table odds |
|---|---|
| Single number | 35-1 |
| 2 numbers | 17-1 |
| 3 numbers | 11-1 |
| 4 numbers | 8-1 |
| 6 numbers | 6-1 |
| 9 numbers | 4-1 |

TABLE 2-continued

| Table odds for 75 number roulette wheel. | |
|---|---|
| | Table odds |
| 12 numbers | 2-1 |
| 24 numbers | 1-1 |
| Odd | 1-1 |
| Even | 1-1 |
| Red | 1-1 |
| Black | 1-1 |

With reference to the roulette wheel 92 of FIG. 7, Double Win Roulette is a variation on standard Roulette. The Double Win Roulette wheel has seventy-five total slices; seventy-two slices numbered 1 through 72, one 0 slice, one 00 slice, and one 000 slice. Double Win Roulette also utilizes two independent balls per round, with one ball designated as the Golden Ball. The balls may land in separate wheel slices or the same wheel slice.

To begin gameplay, the player makes any combination of the wagers listed in Table 3 and Table 4. When wagering on the Single Number wager, the player is paid depending on how many balls land within the slice marked by the player's wager. All other wagers are paid based on the slice in which the Golden Ball lands only. The cost of a wager includes both balls.

TABLE 3

| Double Win Roulette single number wager and pays | | |
|---|---|---|
| Wager | One Ball | Two Balls |
| Single Number | 35 to 1 | 70 to 1 |

TABLE 4

| Double Win Roulette other wagers and pays | |
|---|---|
| Wager | Golden Ball |
| 2 Numbers | 17 to 1 |
| 3 Numbers | 11 to 1 |
| 4 Numbers | 8 to 1 |
| 6 Numbers | 6 to 1 |
| 9 Numbers | 4 to 1 |
| 12 Numbers | 3 to 1 |
| 18 Numbers | 2 to 1 |
| Odd | 1 to 1 |
| Even | 1 to 1 |
| Red | 1 to 1 |
| Black | 1 to 1 |
| 1-36 | 1 to 1 |
| 37-72 | 1 to 1 |

A math analysis for Double Win Roulette was performed theoretically using probability theory. The probability of each event occurring was calculated, and those probabilities were used to determine the Return to Player (RTP) and House Edge (HE) for all wagers. These results are summarized in Table 5 and Table 6.

TABLE 5

| Single number probabilities for RTP and HE | | | | |
|---|---|---|---|---|
| Wager | Probability (1 ball) | Probability (2 Balls) | RTP | HE |
| Single Number | 0.0263 | 0.0002 | 95.911% | 4.02% |

Other Embodiments

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient roadmap for implementing the exemplary embodiment or exemplary embodiments. It should be understood that various changes can be made in the function and arrangements of elements without departing from the scope as set forth in the appended claims and the legal equivalents thereof.

The foregoing description is illustrative of particular embodiments of the invention, but is not meant to be a limitation upon the practice thereof. The following claims, including all equivalents thereof, are intended to define the scope of the invention.

The invention claimed is:

1. A roulette based game system, comprising:

a roulette wheel with an upper track and a lower track around a circumferential edge of the roulette wheel, the upper track and the lower track both having semi-circular cross-sectional curvatures that complement a first roulette ball and a second roulette ball, respectively, the upper track and the lower track being vertically stacked such that the lower track at least partially vertically underlies the upper track;

a series of numbered and color coded pockets arranged in a circle concentric with said roulette wheel;

the first roulette ball and the second roulette ball for simultaneous play using the upper track and the lower track of the roulette wheel, respectively; and a table surface holding the roulette wheel and a betting layout in a grid corresponding to the number of pockets in the roulette wheel for placing bets on the outcome of a roll of the roulette wheel.

2. The system of claim 1 wherein said series of numbered and color coded pockets correspond to 63 numbers, the 63 numbers consisting of 0, 00, 000, and 1-60.

3. The system of claim 2 wherein said layout has a grid of 63 numbers (0, 00, 000, 1-60), and areas for placing bets on one or more of the following: $1^{st}$ 20 numbers (1-20), $2^{nd}$ 20 numbers (21-40), and $3^{rd}$ 20 numbers (41-60); numbers 1-30, numbers 31-60; even or odd, red or black; and 2 for 1.

4. The system of claim 1 wherein said series of numbered and color coded pockets correspond to 75 numbers, the 75 numbers consisting of 0, 00, 000, and 1-72.

5. The system of claim 4 wherein said layout has a grid of 75 numbers (0, 00, 000, 1-72), and areas for placing bets on one or more of the following: $1^{st}$ 24 numbers (1-24), $2^{nd}$ 24 numbers (25-48), and $3^{rd}$ 24 numbers (49-72); numbers 1-36, numbers 37-72; even or odd, red or black; and 2 for 1.

6. The system of claim 1 wherein a set of playing chips have radio frequency identification (RFID), or other locating devices that interact with the grid to determine chip placement on the betting layout to automatically calculate a bet payoff.

7. The system of claim 1 further comprising a tower having a listing of numbers to indicate past numbers, with current numbers for a roll set as flashing.

8. The system of claim 1 further comprising an electric eye.

9. A roulette based game system having:

a roulette wheel with an upper track and a lower track around a circumferential edge of the roulette wheel the upper track and the lower track;

a series of numbered and color coded pockets arranged in a circle concentric with said roulette wheel;

a first roulette ball and a second roulette ball for simultaneous play using the upper track and the lower track of the roulette wheel, respectively; and a table surface holding the roulette wheel and a betting layout in a grid corresponding to the number of pockets in the roulette wheel for placing bets on the outcome of a roll of the roulette wheel;

wherein the improvement comprises the upper track and the lower track both having a semi-circular cross-sectional curvature that complements the first roulette ball and the second roulette ball, respectively, the upper track and the lower track being vertically stacked such that the lower track at least partially vertically underlies the upper track, thereby preventing the first roulette ball and the second roulette ball from occupying the same track where they might interfere with one another and hinder gameplay.

* * * * *